United States Patent [19]

Coverstone et al.

[11] 4,356,624

[45] Nov. 2, 1982

[54] FABRICATION TECHNIQUES FOR TUBULAR SHEATHED HEATERS

[75] Inventors: Don A. Coverstone, Larwill; Larry G. Harris, North Webster, both of Ind.

[73] Assignee: Lyall Electric, Inc., Albion, Ind.

[21] Appl. No.: 176,109

[22] Filed: Aug. 7, 1980

[51] Int. Cl.[3] ..... H05B 3/00

[52] U.S. Cl. ..... 29/611; 219/530; 219/535

[58] Field of Search ..... 219/535, 301, 530, 536, 219/540; 174/110 R, 110 SR, 138 F; 29/611

[56] References Cited

U.S. PATENT DOCUMENTS

| | | | |
|---|---|---|---|
| 3,730,262 | 5/1973 | Drugmand | 219/535 |
| 3,730,373 | 5/1973 | Kogbelt | 219/535 |
| 3,873,810 | 3/1975 | Laren | 219/535 |
| 3,887,790 | 6/1975 | Ferguson | 219/535 |
| 3,937,870 | 2/1976 | Bumpstead | 174/138 F |
| 4,292,503 | 9/1981 | Brent | 219/535 |

*Primary Examiner*—Leon Gilden

*Attorney, Agent, or Firm*—Albert L. Jeffers; Roger M. Rickert

[57] ABSTRACT

Electric heater assemblies to encircle and warm hermetic compressor housings are fabricated by the selection of a sheathed tubular heating element of a length of the same order of magnitude as the circumference of the compressor housing to be encircled and a bend is introduced near the end of the selected element. An elongated tensioning member and the element bend are positioned closely adjacent one another and a mass of non-metallic material molded about the element bend and a portion of the tensioning member to join the member to the selected element. Opposite ends of the tensioning member may be joined to the heating element near the opposite ends thereof by introducing a similar bend near the end opposite the one end of the selected element and similarly juxtaposing the tensioning member and bend and thereafter molding a further mass about the element bend and tensioning member so as to form a loop for encircling the housing. At any convenient time during the fabrication process leads may be attached to the heating element and appropriately insulated as by the molding of electrically insulating material about their junction. The tensioning member may comprise a separable pair of metal straps with an arrangement for coupling those straps together and for moving one strap relative to the other to thereby effectively vary the length of the tensioning member to tighten the assembly about a housing.

8 Claims, 3 Drawing Figures

FABRICATION TECHNIQUES FOR TUBULAR SHEATHED HEATERS

BACKGROUND OF THE INVENTION

The present invention relates generally to heater fabricating techniques and more particularly to processes for joining heating elements and their associated mounting hardware, and particularly to such a process for fabricating an electric heater assembly for encircling a hermetic compressor housing.

The refrigeration and air conditioning industry generally has long recognized the utility of providing a heating element to raise the temperature of the compressor lubricant above that of the refrigeration system refrigerant to minimize the mixing of those two materials and the distribution of the lubricant throughout the system.

The current technique for providing such a heater is to join the opposite ends of a tensioning band to the opposite ends of the heater element and then tighten the band so that the assembly firmly grips the outside of the housing. The tensioning band is frequently constructed like a typical automobile radiator hose clamp, that is, it is formed from a pair of metallic strips, one of which supports a threaded member, while the other includes a series of equally spaced transverse slots which engage a portion of the threads of that threaded member so that when the threaded member is turned, one strip is moved relative to the other.

While this known system has met with considerable commercial success, the attachment of the tensioning member ends to the heater element ends continues to be a source of substantial expense, as well as a source of heater failure, due to galvanic action, where dissimilar metals are in contact.

More particularly, the joining of each tensioning member end to its respective heater element end is accomplished currently by providing a metal component formed to be clamped about the heater element near its end and welded to the corresponding end of the tensioning member. Thus, at each heating element end, there are two interfaces between dissimilar metals, a forming operation, a welding operation, and a clamping operation required to join the tensioning member end to the heating element end. Industry use of at least three different materials for the outer layer of the sheathed heating element further compound the problem of appropriate material selection to minimize electrolytic action at these metal to metal junctions.

SUMMARY OF THE INVENTION

Among the several objects of the present invention may be noted the provision of a method of joining a strap and a tube while avoiding any problems associated with junctions of dissimilar metals; the provision of an improved compressor heating assembly of reduced cost; the elimination of galvanic action problems associated with compressor heaters; the elimination of several steps from the known prior art technique for fabricating tubular sheathed heaters; and the elimination of metal to metal contact and therefore also associated corrosion problems in hermetic compressor housing heaters. These as well as other objects and advantageous features of the present invention will be in part apparent and in part pointed out hereinafter.

In general an electric heater assembly for encircling a hermetic compressor housing is made by selecting a sheathed tubular heating element of a length to encircle most of the compressor housing to which electrical lead wires are connected and appropriately insulated. The selected element is bent near one end thereof and an elongated tensioning member positioned close to the bend and a mass of non-metallic material is molded about the bend and a portion of the tensioning member to securely join the member to the selected element. This bending and molding process may be effected at both heater element ends to thereby form a loop of the heater element and tensioning member. The heater assembly is then placed over a compressor housing and the tensioning member shortened to tighten the assembly about the housing in a secure manner.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
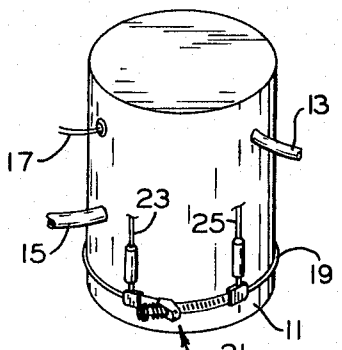
FIG. 1 is a perspective view of a hermetic compressor housing encircled by an electric heater assembly according to the present invention.

In FIG. 1 a hermetic compressor housing for a refrigeration type system of conventional design contains a motor-compressor unit with refrigerant inlet and outlet tubes 13 and 15 as well as electrical leads 17 passing through the housing 11. Near the bottom of the housing where the oil sump is located, a heating element 19 encircles the housing in good heat transfer relation therewith. The heating element is held tightly against the housing 11 by an elongated tensioning member 21 and electrical leads 23 and 25 extend from the heating element to be appropriately connected for heating the sump when desired. The details of the heater assembly will be better understood by referring to FIG. 2.

Figure 2:
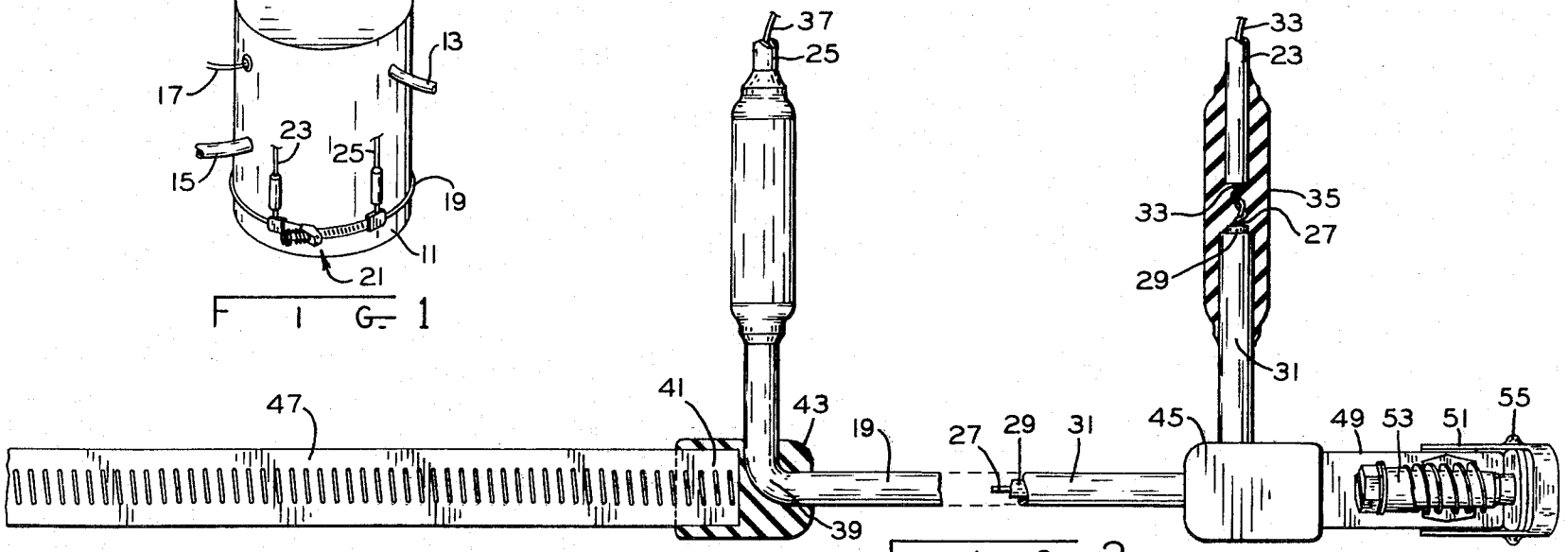
FIG. 2 is a plan view of the heater assembly of FIG. 1 prior to being formed in a loop to encircle the housing.

In FIG. 2, the sheathed tubular heating element 19 contains one or more resistance wires 27 enclosed within an electrically insulating material 29 of a type which does not deteriorate at elevated temperatures. A metallic tubular sheath 31, typically of copper, aluminum or stainless steel surrounds and protects the resistance wire 27 and insulation 29. The electrical leads 23 and 25 are joined to the ends of the heating element by having their respective conductors, such as 33, welded, soldered or crimped to the corresponding resistance wire 27 and thereafter this junction is insulated, for example by molding insulating material 35 thereabout. Conductor 37 of lead 25 is similarly connected to the heating element.

A corrosion proof mechanical connection is formed between heating element 19 and tensioning member 21 by forming an elbow bend 39 near one end of the selected heating element and then juxtaposing that bend with end 41 of the tensioning member and thereafter molding a mass 43 of non-metallic material about the element bend and a portion of the tensioning member to join the member to the selected element. This molding may be accomplished by injection molding techniques, for example in a simple rectangular cavity contoured in the parting plane on two adjacent sides of the rectangle to accept the metal clad heating element and on a third side generally in alignment with the direction of elongation of the main body of the heating element to accept end 41 of the tensioning member. One suitable molding compound is polyphenylene sulfide, however, many other suitable materials are available. The other end of the tensioning member 21 may similarly be connected to the other end of the heating element 19 as by the molded mass 45.

The elongated tensioning member 21 may comprise a pair of metal straps 47 and 49 of which strap 47 is provided with a series of slots while 49 may be unslotted but have crimped thereto a bracket 51 containing a hinged screw 53 which may be pivoted toward and away from strap 49 about the pivot axis 55. It will be noted that the screw 53 has the same pitch as the separation between the slots in metal strap 47 so that the free end of strap 47 may be passed through bracket 51 between screw 53 and strap 49 and thereafter screw 53 pivoted toward strap 49 so that the screw threads engage the slots in strap 47 and thereater rotation of screw 53 will move one of the straps relative to the other to thereby effectively vary the length of the tensioning member and therefore also the circumference of the loop. With this particular tensioning member configuration, the two straps may be molded to the heating element while the straps are separated and subsequently the straps joined to form the generally circular configuration of the heater assembly. The heater assembly is then, of course, simply slipped over the canister, such as compressor housing 11, and the screw 53 tightened to tighten the loop about the housing.

Figure 3:
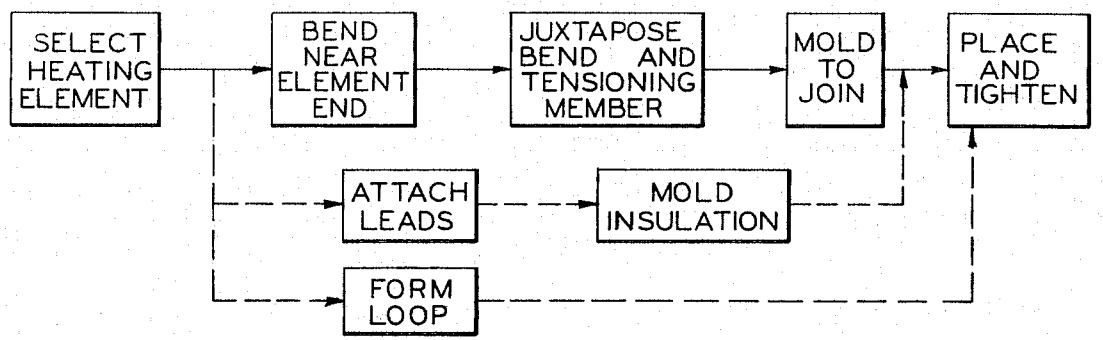
FIG. 3 is a flow chart illustrating the process of fabricating the heater assembly of FIGS. 1 and 2.

Certain of the process steps should be effected in a particular sequence, as illustrated by the solid connecting arrows in FIG. 3, while the particular stage in the process during which other of the steps are effected, is somewhat arbitrary, as illustrated by dotted arrow lines in FIG. 3. Initially a heating element of appropriate length to nearly encircle the compressor housing and provide sufficient heater element extending beyond the connecting bends to allow the connection of lead wires 23 and 25 is made. The heating element should be of sufficient length to contact most of the periphery of the canister and normally a heating element of a length approximately equal to the circumference of the housing is selected. This heater element length should be at least within one order of magnitude of the circumference of the housing. Bends near the element ends, such as 39, are next introduced into the heating element and thereafter that bend is positioned adjacent a tensioning member end to be joined thereto by molding the mass of non-magnetic material about both the elbow and the tensioning member end. The heating element may be formed into a partial loop to generally conform to the exterior of the compressor housing at any time after the particular heating element is selected, and similarly the attachment of wires 23 and 25 and the subsequent insulation of those lead wires junctions may be accomplished at any time during the process. Placing the heater assembly about the compressor housing and tightening the tension member to secure the heater assembly to the housing is normally the last step in the process.

From the foregoing it is now apparent that a novel method of making an electric heater assembly has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. The method of making an electric heater assembly for encircling a hermetic compressor housing comprising the steps of:

selecting a sheathed tubular heating element of a length of the same order of magnitude as the circumference of the housing;

attaching electrical lead wires to the selected element;

bending the selected element near one end thereof;

juxtaposing one end of an elongated tensioning member and the element bend; and molding a mass of non-metallic material about the element bend and a portion of the tensioning member to join the member to the selected element.

2. The method of claim 1 including the additional steps of:

bending the selected element near the other end thereof;

juxtaposing the other end of the elongated tensioning member and the other end bend; and molding a mass of non-metallic material about the other end bend and a portion of the tensioning member near said other end thereof to join the tensioning member other end to the selected element.

3. The method of claim 2 wherein the elongated tensioning member comprises a separable pair of metal straps and means coupling the straps together and for selectively moving one strap relative to the other to thereby effectively vary the length of the tensioning member, the steps of juxtaposing and molding being performed while the straps are separated, the method including the additional step of joining the straps to form the heating element and tensioning member into a generally circular configuration.

4. The method of claim 1 wherein the step of attaching electrical lead wires includes molding electrically insulating material about the lead wire-element junctions.

5. The method of claim 1 including the further step of forming the heating element and tensioning member into a generally circular configuration.

6. The method of claim 5 including the further step of reducing the circumference of the circle while the assembly encircles a compressor housing to fasten the assembly to the housing in good heat transfer relation therewith.

7. The method of claim 1 including the further step of forming the heating element into a portion of a loop to conform generally to the compressor housing.

8. The method of claim 7 including the further steps of completing the loop with the tensioning member and reducing the size of the loop while the assembly encircles the compressor housing to tighten the loop about the housing.

* * * * *